United States Patent [19]

Cassens, Jr. et al.

[11] Patent Number: 5,018,709

[45] Date of Patent: May 28, 1991

[54] MAKING A TAPHOLE

[76] Inventors: Nicholas Cassens, Jr., 4082 Suffolk Way, Pleasanton, Calif. 94566; Robert Rodrigues, 1261 Jefferson Ave., Salem, Ohio 44460

[21] Appl. No.: 394,723

[22] Filed: Aug. 16, 1989

Related U.S. Application Data

[62] Division of Ser. No. 232,005, Aug. 15, 1988, abandoned.

[51] Int. Cl.[5] ..... B22D 41/52

[52] U.S. Cl. ..... 266/271; 222/591

[58] Field of Search ..... 266/236, 271; 222/591; 138/145, 146, 177

[56] References Cited

U.S. PATENT DOCUMENTS

| | | | |
|---|---|---|---|
| 3,206,183 | 9/1965 | Marwick, Jr. | 138/145 |
| 3,820,947 | 6/1974 | Boto et al. | 138/145 |
| 3,879,208 | 4/1975 | Cassens, Jr. | 501/95 |
| 4,142,555 | 3/1979 | Satake et al. | 138/145 |
| 4,208,214 | 6/1980 | Stein et al. | 501/95 |
| 4,397,338 | 8/1983 | Cunningham | 138/145 |

*Primary Examiner*—S. Kastler, III

[57] ABSTRACT

A preformed taphole for a steelmaking vessel such as a BOF furnace or a ladle is made by forming refractory material about a steel pipe, the refractory comprising refractory aggregate, a water soluble binder, metal fibers such as stainless steel fibers, and graphite, preferably flake graphite.

9 Claims, 1 Drawing Sheet

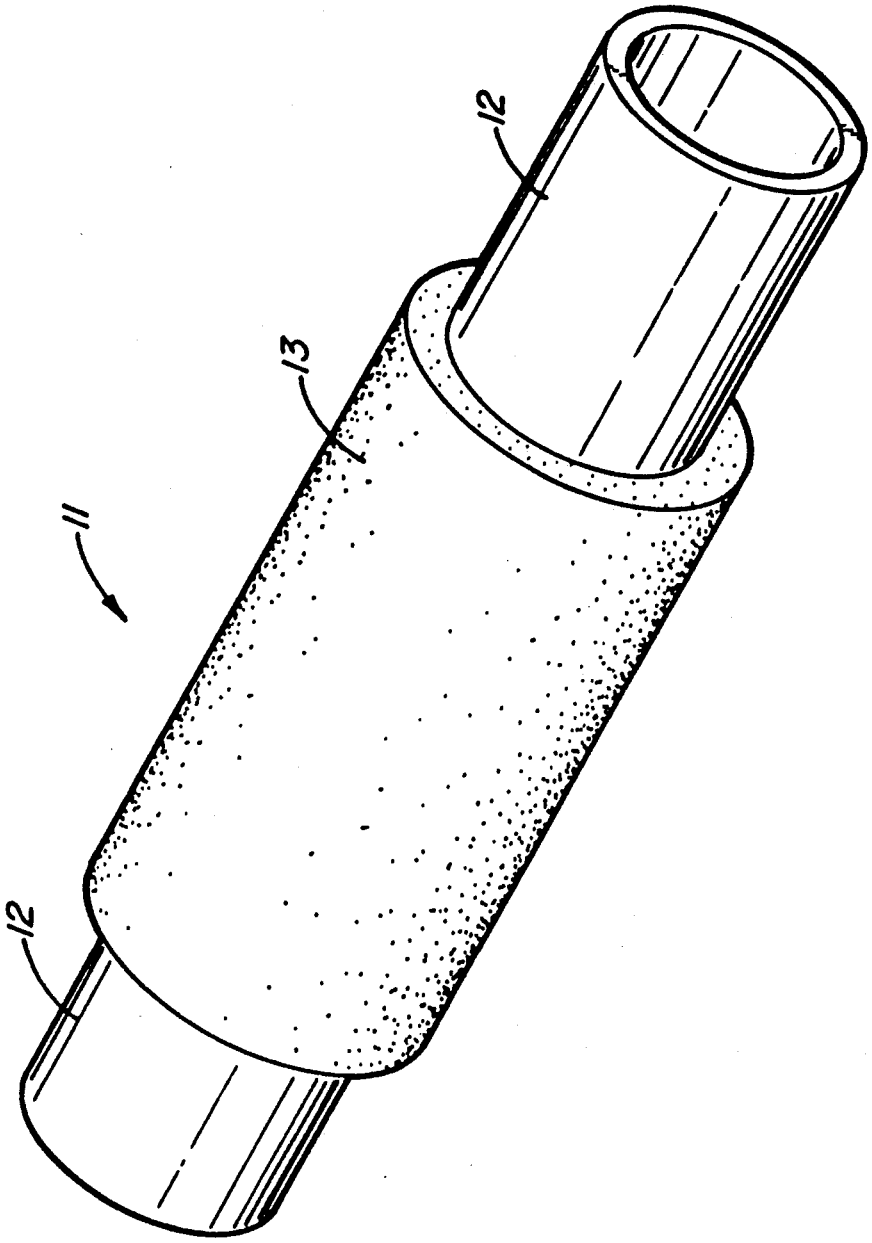
12
13
11
12

MAKING A TAPHOLE

This is a divisional of co-pending application Ser. No. 07/232,005 filed on Aug. 15, 1988, now abandoned.

BACKGROUND OF THE INVENTION

This invention concerns a method of making a preformed taphole and a refractory composition for use therein.

Tapholes are openings, usually round, in the wall of a melting furnace such as a BOF furnace or other metal melting furnace through which metal and/or slag can be poured when the furnace is tilted or when a plug or other closing device in the taphole is removed. Tapholes are generally made of refractory material which is compatible with the refractory material used in lining the furnace or other molten metal container.

As the steel or other molten metal pours through the taphole, it causes wear on the refractory making up the taphole. Generally, the refractory making up the taphole wears much faster than the refractory making up the furnace lining and therefore the taphole has to be replaced on a regular basis during the life of the lining.

While it is possible to repair the taphole in place, for example by gunning refractory around a form placed in the old taphole (which has become enlarged by wear), such repair is less than totally satisfactory. Since such repairs have to be made on a hot furnace (it not being economical to cool the furnace down to make the repair), the refractory forming the repaired taphole is of lesser strength and density, due to the increased amount of water required to gun refractory material, and hence will last for an even shorter time, than a taphole formed by methods such as casting or pressing, methods which result in greater density and strength but which cannot be used to repair a hot furnace.

Accordingly, it has become the practice to preform refractory tapholes and then place them in the furnace to be repaired, the preformed taphole being held in place by, for example, refractory material gunned around it.

Generally, such preformed tapholes are made by forming suitable refractory material, for example by casting, about a hollow metal pipe used as a form. In the first few seconds that molten metal flows through the taphole so formed, it washes away the metal and thereafter the refractory channels the metal flow.

This invention is concerned with a method of making an improved preformed taphole and particularly with a refractory composition useful in making such an improved taphole.

SUMMARY OF THE INVENTION

According to this invention, an improved preformed taphole can be made by the method comprising (1) selecting a metal pipe of the desired length and diameter, (2) admixing (a) from 1% to 8% of a water soluble binder, (b) from 0.1% to 2% of metal fibers (c) and 0.5% to 5% graphite with (d) refractory grain making up the balance of the admixture, all percentages being by weight and based on the total weight of the admixture, (3) adding sufficient tempering liquid to the admixture to make a formable refractory mass, (4) forming the tempered admixture about the outer surface of the metal pipe, and (5) drying the so-formed refractory mass to make a preformed taphole.

BRIEF DESCRIPTION OF THE DRAWING

The drawing is a perspective view of a preformed taphole which can be made by the method of this invention.

DETAILED DESCRIPTION OF THE INVENTION

The pipe used as a form about which to mold the refractory can be of any metal, for example aluminum, but generally will be of iron or steel. Commonly steel pipe is used. The diameter of the pipe will be chosen to conform the size of taphole desired by the customer (e.g., a steelmaker) and the length also will be chosen to fit the particular furnace in which the taphole is to be used. Generally, the steel pipe will be longer than the refractory wall thickness of the furnace. The wall thickness of the steel pipe is not critical, for example it can be from ⅛ inch to ¼ inch; generally the steel pipe will be in the thinnest which can be used in the forming process and which can be shipped and handled without deforming.

The aggregate used in refractory surrounding the pipe should be compatible with the refractory making up the lining into which the taphole is to be place. Generally, this will be a basic lining such as periclase or periclase/chrome. A particularly preferred aggregrate is high purity periclase, i.e., one containing 95% or more MgO. The aggregate will be sized, as is well known in the industry, to provide maximum packed density.

The water soluble bond can be any such material or combination of materials compatible with the aggregate and able to provide a strong bond in the composition. Such bonds are well known in the refractory art; a particularly preferred one is shown in the example below.

The metal fibers may be any such; preferably they will have a length of from 1 to 3 cm and a diameter of 0.02 to 0.6 mm. Usually the fibers will be steel and most preferably stainless steel. A variety of such metal fibers are commercially available.

The graphite used may be any of various commercially available graphites but referred graphite is the type known, from its morphology, as flake graphite. It will preferably be of a size so that at least 90 of it is larger than 0.05 mm.

In forming the taphole, the requisite amounts of refractory aggregrate, bond, fibers, and graphite will be admixed in a suitable mixer, for example a Hobart epicyclic mixer, as is well known in this art. A tempering liquid, usually water but other liquids such as alcohol might be used in particular cases, is then added to the admixture. The amount of tempering liquid will depend on the forming method to be used. A preferred forming method is casting and this will generally require from about 3% to about 8% water, based on the weight of dry ingredients. For pressing, on the other hand, a much smaller amount, perhaps about 2% water will be used.

The tempered refractory admixture is then placed about the metal pipe. As mentioned, placement by casting the refractory about the metal pipe as the inner form, and using a removable sleeve, for example a split steel pipe, as the outer form, is a preferred forming method. The thickness of the refractory may be, for example, from ¾ inch (2 cm) to 2 inches (5.1 cm).

The refractory will be placed completely about the circumference of the metal pipe, but will generally not extend to both ends of the pipe. In some cases, it may be terminated short of each end of the pipe, as shown in the drawing, wherein the preformed taphole is indicated generally by the numeral 11, the metal pipe by 12, and the refractory by 13. The reason for the pipe to extend beyond the refractory is to provide means to handle the preformed taphole without damaging the refractory and also to prevent damage due to the inadvertent hitting of the taphole against the furnace or other structure.

The formed taphole will be dried or otherwise cured (depending on the type of bond used) before being shipped to the customer, who will install it in his furnace or other device.

EXAMPLE

A taphole was made according to this invention by admixing 97.9 parts by weight sized periclase grain with 0.8 part aluminum sulfate, 0.7 part boric acid, 0.6 part citric acid, 0.5 part F-310 stainless steel fibers ¾ inch (19 mm) long, and 1.0 part natural flake graphite.

The periclase had the following typical chemical analysis: 0.8% CaO, 0.3% $SiO_2$, 0.2% $Fe_2O_3$, 0.05 % $Al_2O_3$, less than 0.02 % $B_2O_3$, and ( by difference) 98.6 % MgO, and was sized so that all passed a 3 mesh screen (i.e., was a finer than 6.7 mm) and 22% passed a 100 mesh sreen (i.e., was a finer than 0.15 mm).

The aluminum sulfate, boric acid, and citric acid were the commercially available materials described in detail in U.S. Pat. No. 3,879,208.

The dry ingredients were mixed in an epicyclic Hobart mixer for 1 minute and then 5% water (based on the weight of dry ingredients) added and the mixing continued for a further 4 minutes.

The admixture was then cast about a 6 inch (15 cm) diameter steel pipe 5 feet (1.5 m) long and having a wall thickness of 3/16 inch (5 mm). A steel form of 7.5 inches (19 cm) inner diameter was placed concentrically about the metal pipe and the refractory admixture cast between the two using vibration to obtain maximum density.

The taphole thus formed was stripped of the outer form after setting at ambient temperature over night and then was heated on a preset schedule to a temperature of 600° F. (315° C.) over a period of 30 hours before being shipped to the customer.

Preformed tapholes made according to this invention were installed in BOF furnaces in a steelmaking plant. In the newest furnace, the tapholes made according to this invention had an average life of 48.6 heats, and in the oldest furnace an average life of 32.3 heats. This compares to an average life for prior art performed tapholes not containing the combination of graphite and metal fibers of 33 heats in the newest furnace and 22.5 heats in the oldest furnace.

While the reasons for the superior performance of tapholes made with the combination of metal fibers and graphite is not fully understood, and it is not desired to be bound to any particular theory, it is believed that the graphite prevents slag penetration into the refractory, allowing the metal fibers to perform their strengthening and reinforcing function for a longer time.

In the specification and claims, percentages and parts are by weight unless otherwise indicated. Mesh sizes referred to herein are Tyler standard screen sized which are defined in Chemical Engineer's Handbook, John S. Perry, Editor-in-Chief, Third Edition, 1950, published by McGraw Hill Book Company, at page 963. Analyses of mineral components are reported in the usual manner, expressed as simple oxides, e.g. MgO and $SiO_2$, although the components may actually be present in various combinations, e.g. as a magnesium silicate.

We claim:

1. A preformed taphole comprising (1) a hollow metal pipe and (2) a refractory mass formed about the exterior circumference of said pipe over at least a portion of its length, said refractory mass consisting essentially of (a) from 1% to 8% of a water soluble binder, (b) from 0.1% to 2% metal fibers, and (c) 0.5 to 5% flake graphite at least 90% of which is larger than 0.05 mm, with (d) basic refractory grain making up the balance of the admixture, all percentages being by weight and based on the total weight of the admixture.

2. Taphole according to claim 1 wherein the basic refractory grain is periclase.

3. Taphole according to claim 1 wherein the metal fibers are steel fibers.

4. Taphole according to claim 3 wherein the fibers are stainless steel.

5. Taphole according to claim 1 wherein the water soluble binder comprises aluminum sulfate, boric acid, and citric acid.

6. Taphole according to claim 5 wherein the bond comprises about 0.8% aluminum sulfate, about 0.7% boric acid, and about 0.6% citric acid.

7. Taphole according to claim 1 wherein the basic refractory grain is periclase and the fibers are stainless steel.

8. Taphole according to claim 7 wherein the binder comprises aluminum sulfate, boric acid, and citric acid.

9. Taphole according to claim 8 wherein the binder comprises about 0.08% aluminum sulfate, about 0.7% boric acid, and about 0.6% citric acid.

* * * * *